US005791178A

United States Patent [19]

Chamberlain et al.

[11] Patent Number: 5,791,178

[45] Date of Patent: Aug. 11, 1998

[54] ELECTRICAL TRANSMISSION PATH FOR ELECTRICAL AND ELECTRO-MECHANICAL LOCKS

[75] Inventors: L. C. Derek Chamberlain, Colorado Springs, Colo.; Richard M. Davidian, Avon, Conn.

[73] Assignee: Schlage Lock Company, San Francisco, Calif.

[21] Appl. No.: 578,259

[22] Filed: Dec. 26, 1995

[51] Int. Cl.[6] ..... E05B 49/00; E05B 47/00

[52] U.S. Cl. ..... 70/278; 70/279; 70/277

[58] Field of Search ..... 70/278, 277, 279, 70/280, 281, 282, 283; 292/336.3; 340/825.31, 825.32, 825.34, 64, 533

[56] References Cited

U.S. PATENT DOCUMENTS

| | | | |
|---|---|---|---|
| 5,005,884 | 4/1991 | Fish et al. | 292/336.3 |
| 5,010,752 | 4/1991 | Lin | 70/277 |
| 5,018,375 | 5/1991 | Tully | 70/472 |
| 5,027,629 | 7/1991 | Liu | 70/277 |
| 5,040,391 | 8/1991 | Lin | 70/277 |
| 5,083,122 | 1/1992 | Clark | 340/825.32 |
| 5,140,317 | 8/1992 | Hyatt, Jr. et al. | 70/278 |
| 5,321,575 | 6/1994 | Shilo | 361/56 |
| 5,367,295 | 11/1994 | Gokcebay et al. | 340/825.31 |
| 5,423,198 | 6/1995 | DiVito et al. | 70/278 |

*Primary Examiner*—Steven N. Meyers
*Assistant Examiner*—Tuyet-Phuong Pham
*Attorney, Agent, or Firm*—Robert F. Palermo; Michael H. Minns

[57] ABSTRACT

An apparatus for providing an electrical transmission path in a door lock to an electrical lock operating system from an electrical contact pin protruding axially from a pin tower of an insulated key cylinder having an electronic touch button for a front face, the door lock having an outside spindle operably engaged with a door handle containing the insulated key cylinder, includes an insulated contact ring surrounding the spindle and having an electrically conductive pad on a portion of its outwardly facing surface, which contacts the electrical contact pin when the door handle is in its parked position, and a cable connected to the conductive pad and extending through the non-moving part of the door lock to the controlling electronics of the lock.

9 Claims, 2 Drawing Sheets

ELECTRICAL TRANSMISSION PATH FOR ELECTRICAL AND ELECTRO-MECHANICAL LOCKS

RELATED APPLICATIONS

This application incorporates by reference applications Ser. No. 08/561,673, now abandoned, entitled ELECTRICAL ISOLATION OF KEY CYLINDER FOR ELECTRONIC LOCKS, and Ser. No. 08/567,824, abandoned entitled NON-CONDUCTING ACTUATOR TOP FOR AN ELECTRONIC LOCK. The referenced applications are assigned to the same assignee as the present application.

BACKGROUND OF THE INVENTION

This invention relates generally to electrical and electro-mechanical locks and more particularly to an apparatus for providing an electrically conductive path, free of short circuits, between electrical and electronic components of such locks.

Locksets operated by both a traditional mechanical key and an electronic touch button are becoming more commonly available in the door hardware industry. In order to have the desired capability for dual operating modes, such locksets require the touch button target, against which the touch button key is applied, to be insulated from the chassis of the lock. This saves battery energy and protects electronic control signals by eliminating short circuits between the key cylinder and the chassis. A device for insulating a key cylinder from the associated lever, spindle, and chassis has been disclosed in two abandoned patent applications Ser. No. 08/561,673, entitled "ELECTRICAL ISOLATION OF KEY CYLINDER FOR ELECTRONIC LOCKS", and Ser. No. 08/567,824, NON-CONDUCTING ACTUATOR TOP FOR AN ELECTRONIC LOCK, which are commonly assigned, herewith, and are incorporated herein, by reference. The present invention addresses a preferred method of providing an electrically conductive path, around and through the electrically isolated key cylinder and latch actuator top, between an electronic touch button target and an electrical lock operating system in a lock operable by mechanical and electro-mechanical means. Transmittal of electronic impulses from the insulated touch pad target to the electrical lock control is required for full operation of the lock. Without such provision, the electrical mode of the lock operation will not function at all.

Locks are usually constructed mostly from metal, especially the mechanical operating components, and have numerous electrically conductive paths between those components during operation. Operation in the electronic mode requires that the electrical signal between the touch button key and the touch button target not be attenuated or altered by drainage of charges nor by importation of stray signals from contact with conductive surfaces in the lock chassis. This can be accomplished by making the lock parts from insulating polymers, ceramics, or other non-conductive materials. However such construction can result in locks having high cost together with inadequate strength, durability, and reliability. For example, compared to metals, polymers may be softer and weaker, while ceramics may be hard and brittle. Both materials are usually less durable than metals while often more costly. Of course, strength limitations can be compensated for by making parts thicker and larger, but very quickly, this approach results in oversize locksets which are unattractive and which do not fit in standard door preparations.

Another approach to electrical isolation is physical separation of the mechanical and electronic key provisions to prevent short circuits, but this is not favored because it increases the complexity and cost of the lockset, by requiring duplication of many functions, and detracts from operating convenience by requiring separated key application points.

Regardless of which approach is taken for insulating the electronic touch button and its associated circuitry from the rest of the lock, provision must always be made for transmittal of electronic impulses from the touch button to the electrical lock operating control system.

The foregoing illustrates limitations known to exist in present mechanical/electromechanical locksets. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, an apparatus is disclosed for providing an electrical transmission path in a door lock to an electrical lock operating system from an electrical contact pin protruding axially from a pin tower of an insulated key cylinder having an electronic touch button for a front face, the door lock having an outside spindle operably engaged with a door handle containing the insulated key cylinder, including an insulated contact ring surrounding the spindle and having an electrically conductive pad on a portion of its outwardly facing surface which contacts the electrical contact pin when the door handle is in its parked position and a cable connected to the conductive pad and extending through the non-moving part of the door lock to the controlling electronics of the lock.

The foregoing and other aspects of the invention will become apparent from the following detailed description, when considered in conjunction with the accompanying drawings.

DETAILED DESCRIPTION

Figure 1:
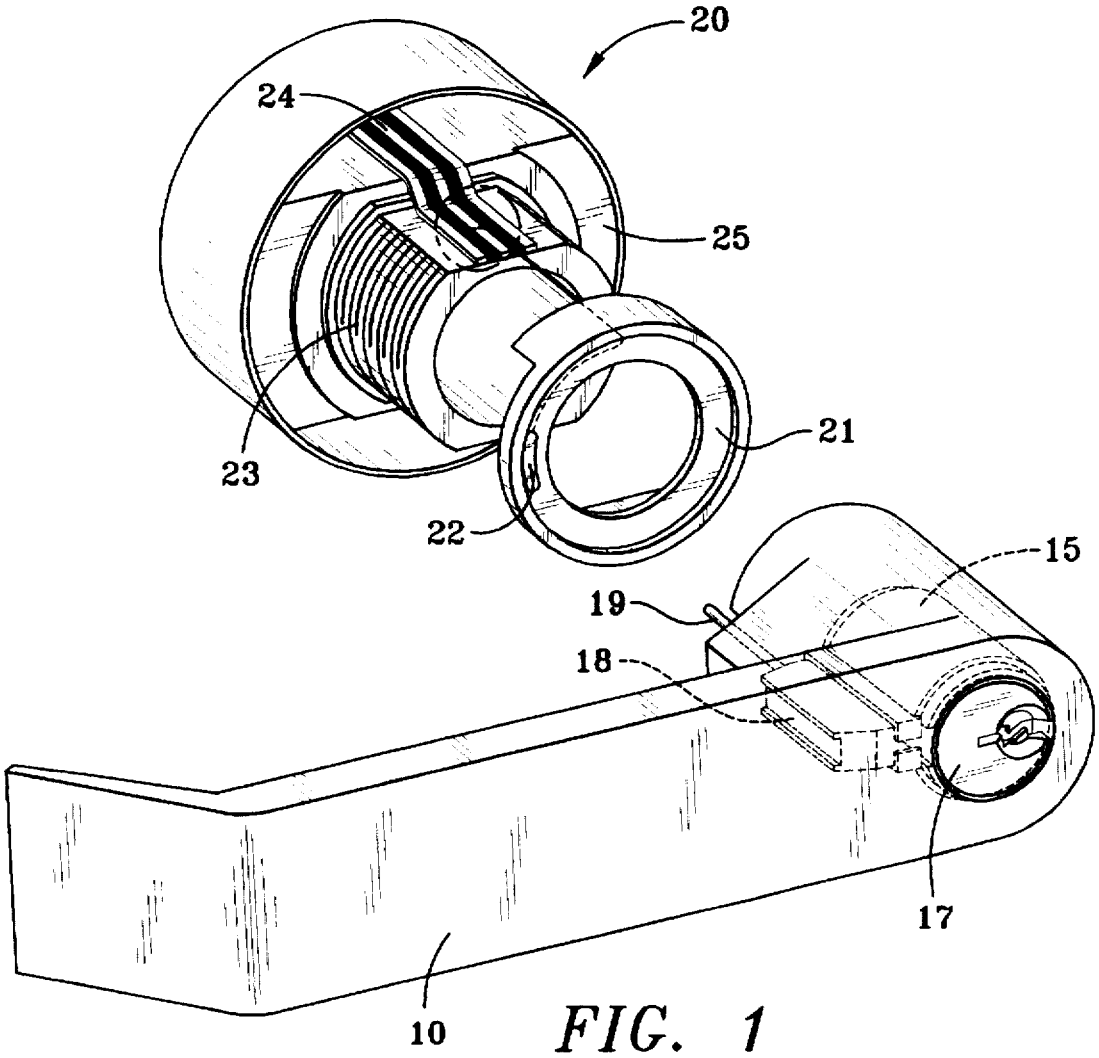
FIG. 1 is a schematic exploded perspective view illustrating one embodiment of the invention in a door lever handle and a portion of a door lock with the outer spindle omitted.

FIG. 1 shows a door lever handle 10, which has a key cylinder 15 with a pin tower 18 and a contact pin 19 mounted within. The front face 17 of the key cylinder 15 is the touch target electronic key contact and also has a slot for the mechanical key. The key cylinder 15, tower 18, and face 17 are insulated from the handle 10 as disclosed in commonly assigned application Ser. No. 08/561,873, abandoned.

Figure 2:
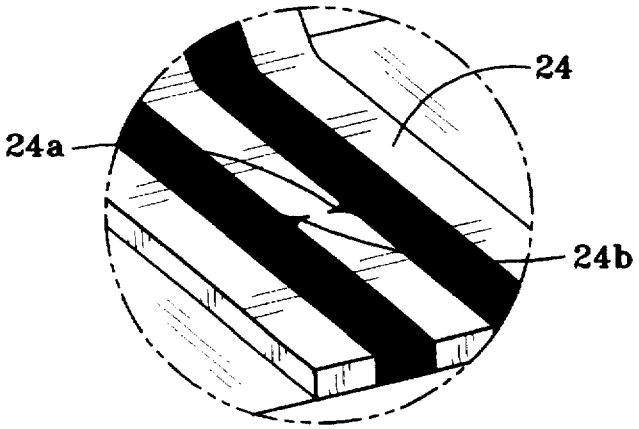
FIG. 2 is a schematic view of the conductor cable showing the excess voltage spark gap feature.

The lockset 20 has a chassis 25 with a hub 23 protruding therefrom, in which is journalled an outside spindle (omitted for clarity). An insulating ring 21 surrounds the outside spindle and is keyed to the hub 23 to prevent rotation of the ring. A conductive pad 22 covers an approximately 20° arc on the outside face of the insulating ring 21 to provide an electrical contact with the contact pin 19 only when the handle 10 is at rest or in the parked position. A two-conductor cable 24 has one conductor connected to the hub 23, or other suitable ground, and the other to the conductive pad 22 of the insulating ring 21 and extends through an inactive portion of the lockset 20 to the controlling electronics. A spark gap is formed, as seen in FIG. 2, between the conductors of cable 24 by asperities **24*a* and 24*b*** on neighboring portions of the conductors to provide a harmless short circuit to ground in case of an excessive voltage being applied to the cable. This provides added protection for the electronic control circuits.

In operation, beginning at the spring loaded contact pin 19, contact is made at conductive pad 22 of the insulating ring 21 and through the ring to the cable 24. The cable runs through the non-critical area of the lockset 20 and out the other side to the controlling electronics. Along the wire path, the conductors have asperities 24*a* and 24*b* which are in close proximity to each other to create a narrow spark gap which dissipates overcharging of the data connection.

This embodiment has several advantages, namely, that false and unwanted signals are avoided by the limited area of conductivity provided on the insulating ring which limits signalling to an "at rest" handle position; that cable runs are easy because they are through a non-critical outer portion of the lock; that the ground connection with the second conductor is easily made; and that the spark gap is easily provided with the two conductor cable.

Figure 3:
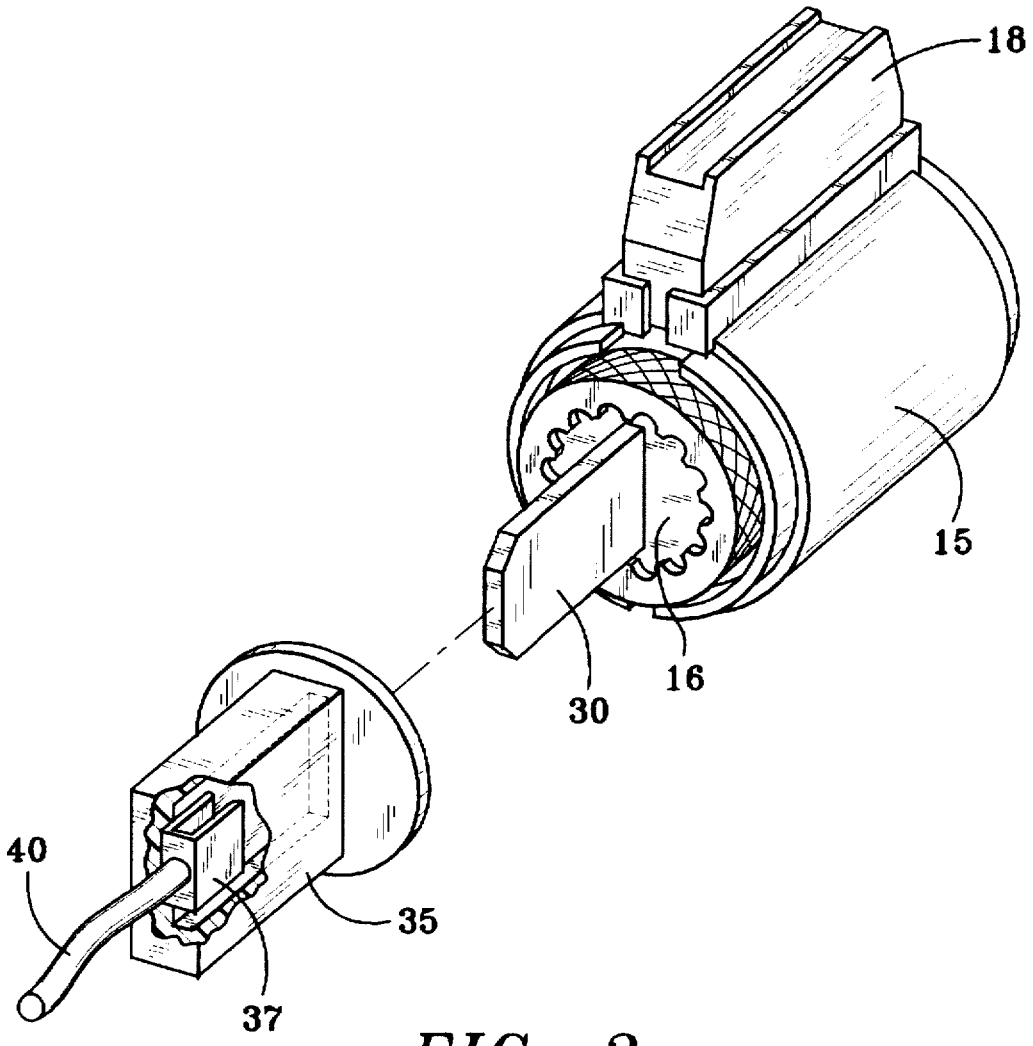
FIG. 3 is an exploded perspective schematic view of an alternative embodiment of the invention.

FIG. 3 shows a second embodiment of the electrical transmission path of the present invention. The insulated key cylinder 15 has an un-insulated back face 16 and tailpiece blade 30. Tailpiece blade 30 drives a latch actuator cam (not shown) in response to operation of the key cylinder 15. A hollow insulating sleeve 35, having a rectangular cross-section and a circular front face, fits snugly over the tailpiece blade 30 to insulate the blade and the back face 16 of the key cylinder 15 from the latch actuator cam (not shown). A clip 37 within the sleeve 35 makes electrical contact with the tailpiece blade 30 and a wire 40 extends from the clip 37 through the inactive portion of the lock to the controlling electronics of the lockset. In this case, connection to the key cylinder 15 is made through the tailpiece 30 by the clip 37 within the insulating sleeve 35, and the insulated conductor wire 40 extends through the center of the lockset 20 and exits in a non-functional area to reach the controlling electronics inside the door. In this embodiment, the benefits include the low cost of the components needed to provide a data path from the key cylinder and the improved reliability of a direct electrical connection not involving a spring loaded contact pin. Clearly, the same insulating action can be achieved using either an insulation-coated latch actuating cam or a latch actuating cam made from a non-conductive material (not shown). The clip 37 is used in all cases to provide the desired electrical path.

Having described the invention, we claim:

1. A door lock operable by either a mechanical key or an electronic touch key, said door lock having an electronic control for an electrical lock operating system, an outside spindle operably engaged with a door handle containing an insulated key cylinder having an electronic touch target for a front face, a contact pin supported by and extending axially from said insulated key cylinder, and apparatus providing an electrical transmission path from said contact pin to said electronic control, said apparatus comprising:

a stationary insulated contact ring surrounding said spindle and having an electrically conductive pad on a portion of an outwardly facing surface, said contact ring being contacted by said electrical contact pin when the door handle is in its parked position; and a cable connected to the conductive pad and extending through a non-moving part of the door lock to the electronic control of the lock.

2. A door lock according to claim 1, wherein said cable comprises a flat, two-conductor cable, a first conductor being grounded to said spindle and a second conductor being connected to said conductive pad, said conductors being parallel in said cable except at a point at which both conductors have asperities which extend toward each other to form a narrow spark gap means for draining away excessive voltage.

3. A door lock according to claim 1, further comprising:

an electrical ground connection from said insulated key cylinder to said outside spindle.

4. A door lock operable by either a mechanical key or an electronic touch key, said door lock having electronic controls for controlling an electrical lock operating system and an outside spindle operably engaged with a door handle containing an insulated key cylinder having an electronic touch target for a front face, a conductive tailpiece extending from said key cylinder, and apparatus for providing an electrical transmission path between said conductive tailpiece and said electronic controls, said apparatus comprising:

means for insulating said tailpiece from the outside spindle;

a conductor cable extending from said electronic controls to said tailpiece; and means for providing electrical contact between said cable and said tailpiece.

5. A door lock according to claim 4, wherein the means for insulating said tailpiece from the outside spindle comprises an insulating sleeve which fits over said tailpiece and insulates said tailpiece from a latch actuator cam operably engaged by said tailpiece.

6. A door lock according to claim 5, wherein the means for providing electrical contact between said cable and said tailpiece comprises an electrical contact clip within said insulating sleeve.

7. A door lock according to claim 4, wherein the means for insulating said tailpiece from the outside spindle comprises an insulating latch actuating cam operably engaged by said tailpiece.

8. A door lock according to claim 7, wherein the means for providing electrical contact between said cable and said tailpiece comprises an electrical contact clip connected to said tailpiece within said latch actuating cam.

9. A door lockset operable by either a standard mechanical key or an electronic touch key, said lockset having an electronic control for controlling its locking state and an insulated key cylinder in a door handle, said key cylinder having a cylindrical body and an electronic touch key signal target as a front face thereof, said key cylinder providing a mechanical drive connection between said door handle, a door latch operating spindle, and a door latch in a chassis of said door lockset, said door lockset further comprising:

a mechanical drive including conductive components for locking and unlocking said lockset in response to operation of said key cylinder;

means for providing an electrical connection for transmitting data signals between said electronic touch key signal target and said electronic control to control the locking state of the lockset, the means for providing electrical connection between said electronic touch key signal target and said electronic control comprising a contactor pin and a slip ring contact, one of which is connected to said signal target and the other of which is connected to said electronic control, and biasing means for maintaining contact between said contactor pin and said slip ring contact regardless of variations in separation between said signal target and said slip ring contact; and means for electrically insulating said mechanical drive from said electrical connection.

* * * * *